United States Patent [19]

Goto et al.

[11] 4,345,852

[45] Aug. 24, 1982

[54] LEVELING DEVICE FOR ASPHALT FINISHER

[75] Inventors: Fumio Goto, Gunma; Kenji Yoshino, Takasaki; Hiroshi Kono, Urawa; Mitsuaki Naito, Koganei, all of Japan

[73] Assignees: Niigata Engineering Co., Ltd.; Nippon Hodo Co., Ltd., both of Tokyo, Japan

[21] Appl. No.: 127,628

[22] Filed: Mar. 6, 1980

[30] Foreign Application Priority Data

May 14, 1979 [JP] Japan ..... 54/63837[U]

[51] Int. Cl.[3] ..... E01C 19/38

[52] U.S. Cl. ..... 404/114; 404/118; 404/120; 404/104

[58] Field of Search ..... 404/102, 108, 96, 119, 404/118, 120, 101, 104, 114

[56] References Cited

U.S. PATENT DOCUMENTS

| | | | |
|---|---|---|---|
| 2,351,593 | 6/1944 | Barber | 404/96 |
| 2,358,085 | 9/1944 | Millikin | 404/96 |
| 2,914,994 | 12/1959 | Pollitz | 404/96 |
| 2,948,202 | 8/1960 | Millikin | 404/119 |
| 2,999,433 | 9/1961 | Baltes | 404/96 |
| 3,130,654 | 4/1964 | Apez | 404/104 |
| 3,182,410 | 5/1965 | Schiavi | 404/96 X |
| 3,435,740 | 4/1969 | McGall | 404/96 |
| 4,093,410 | 6/1978 | Miller | 404/104 X |
| 4,129,399 | 12/1978 | Ruge | 404/104 X |

FOREIGN PATENT DOCUMENTS

| | | | |
|---|---|---|---|
| 2727932 | 7/1978 | Fed. Rep. of Germany | 404/104 |
| 2024900 | 1/1980 | United Kingdom | 404/104 |

*Primary Examiner*—Nile C. Byers, Jr.

*Attorney, Agent, or Firm*—Sughrue, Mion, Zinn, Macpeak and Seas

[57] ABSTRACT

A leveling device for an asphalt finisher or the like including a pair of screeds disposed at front and rear portions of the device on auxiliary frames which are slidably coupled to a main frame. The main frame is pivotably mounted to a pair of supporting arms extending from the vehicle body. The screeds are both movable laterally and tiltable sidewards so that a predetermined depth of asphalt coating can be attained and a crown portion provided if desired.

7 Claims, 8 Drawing Figures

LEVELING DEVICE FOR ASPHALT FINISHER

BACKGROUND OF THE INVENTION

This invention relates to a leveling device for an asphalt finisher, a base paver or the like.

As is well known in the art, for an asphalt finisher as shown in FIG. 1, while a vehicle body 1 is moving, bituminous material supplied from a hopper 2 is delivered to a spreading screw 4 by means of a bar feeder 3 and the asphalt compound is uniformly spread to the right and left by the spreading screw 4 and is then leveled by a screed 5.

In case where a conventional asphalt finisher as described above paves a relatively wide road, auxiliary screeds 6 are provided on either side of the screed 5 as shown in FIG. 2 to cover the entire width of the road. However, this method is disadvantageous in that mounting the auxiliary screeds requires a great deal of time, labor and skill.

In order to eliminate this disadvantage, a technique has been proposed in the art in which, as shown in FIG. 3, wideners 7 are provided on both sides of the screed 5 in such a manner that they are extendably and retractably provided with respect to the screed 5 by hydraulic cylinders. However, this technique is disadvantageous in that, since the wideners 7, unlike the screed 5, have no tamping function, the material leveled by the wideners 7 is different in finish from the material leveled by the screed 5.

In view of the foregoing, an object of the invention is to provide a leveling device by which the leveling width can be readily changed, leveling can be achieved with a uniform finish, and a crown can be provided at a desired position.

SUMMARY OF THE INVENTION

This, as well as other objects of the invention, may be met by a leveling device for an asphalt finisher or the like including a pair of screeds for leveling a material such as bituminous material which is to be spread over a surface such as road surface, wherein the screeds are positioned at the front part of one side of the device and at the rear part of the opposite side of the device with the screeds being movable laterally and tiltable sidewards.

The device preferrably includes a main frame, a pair of supporting arms adapted at one end to be coupled to the body of a vehicle upon which the device is mounted, means for pivotably supporting the main frame on the supporting arms, and an auxiliary frame coupled to and movable vertically with respect to the main frame. The auxiliary frame has bearing means. At least one adjustment screw is provided for maintaining the position of the auxiliary frame at a selected fixed position relative to the main frame. The bearing means may include a pair of bushings which receive a corresponding pair of guided pipes supporting the screeds. The pivotable mounting means for the main frame is a supporting shaft extending through holes in both frames and at least one adjustment screw for maintaining the position of the main frame at a selected fixed tilt position relative to the supporting arms. Means may also be provided for vibrating the screeds. Also, the preferred embodiment includes at least one deflector means laterally slidably mounted to the main frame.

DESCRIPTION OF THE PREFERRED EMBODIMENTS

Figure 1:
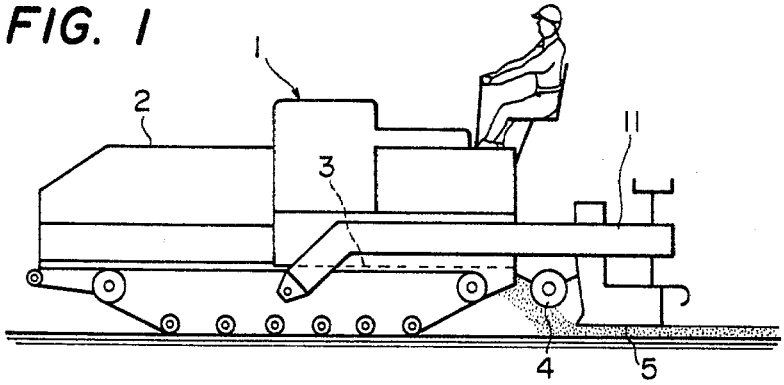
FIG. 1 is a side view of an asphalt finisher equipped with a conventional leveling device.
Figure 2:
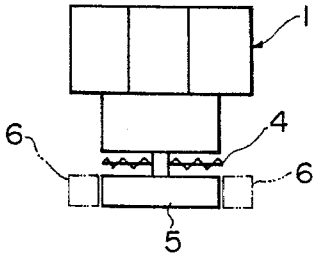
FIGS. 2 and 3 are explanatory diagrams for a description of a conventional leveling width adjusting method.
Figure 3:
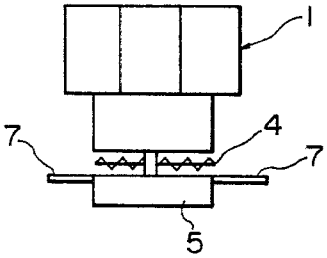

FIG. 4 through FIG. 7 show a preferred embodiment of the invention. In these figures, reference numeral 11 designates supporting arms. Two supporting arms 11 extend backwardly from a vehicle body (not shown), as in the prior art construction, and support a main frame 13 which has an auxiliary frame 12 at the central part thereof. The main frame 13 is pivotally supported by the supporting arms 11 through a supporting shaft 14 so that the main frame 13 can be inclined forwardly and backwardly with the supporting shaft 14 as a fulcrum by operating main frame vertical position adjusting screws 16 screwed in threaded holes 15 (FIG. 7) formed in the supporting arms 11. The auxiliary frame 12 is provided with bearing units 22 and 23 which permit sliding insertion of guide pipes 17 and 18 into bushings 19 and 20, so that it can be moved vertically with respect to the main frame 13 by operating crown adjustment screws 25 which are screwed into threaded holes 24 formed in the main frame 13. Bearing units 26 and 27 FIG. 4A are provided at both end portions of the main frame 13 which confront the bearing units 22 and 23. The bearing units 26 and 27 are adapted to support the guide pipes 17 and 18 in cooperation with the bearing units 22 and 23 so that the guide pipes can slide laterally. The bearing units 22, 23, 26 and 27 are identical in construction and can be moved vertically by means of screed height adjusting screws 33, 34, 35 and 36 which are engaged with threaded holes 28, 29, 31 and 32 formed in the auxiliary frame 12 and the main frame 13. The pairs of adjusting screws 33, 34, 25, 35 and 36 are turned simultaneously by means of sprocket wheels 37*a*, 37*b*, 37*c*, 37*d* and 37*e* and chains 38*a*, 38*b*, 38*c* 38*d* and 38*e* which interconnect them for moving the bearing units vertically. Operating handles 39 are detachably provided for the adjusting screws 16,25,33, 34, 35 and 36 to turn the latter, respectively.

Figure 4B:
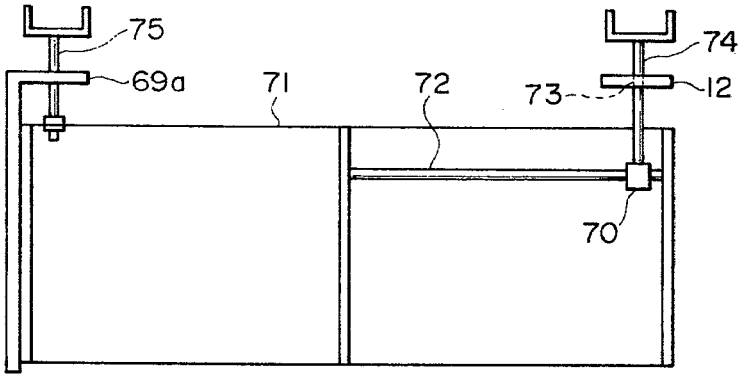
FIG. 4B is a diagram showing the mounting structure of a deflector.
Figure 4A:
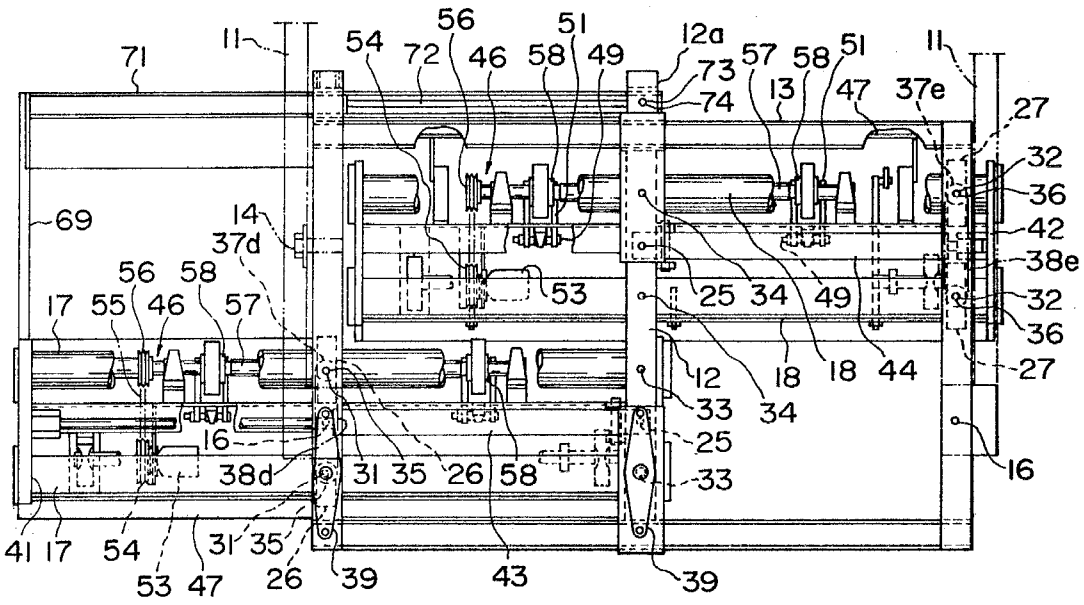
FIG. 4A is a top view of a leveling device according to the present invention.
Figure 5:
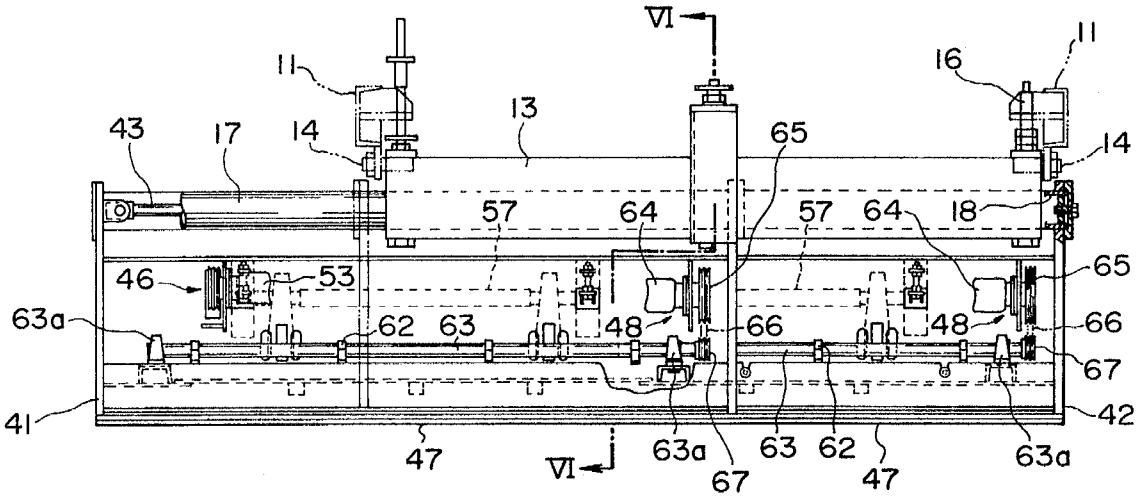
FIG. 5 is a rear view of the leveling device according to the invention.

FIG. 4A shows the state wherein the guide pipe 18 is retracted most leftwardly, while the guide pipe 17 is extended most leftwardly. The guide pipes 17 and 18 have frame members 41 and 42, respectively. The guide pipes 18 closer to the vehicle body are moved to the right in FIG. 4A by a cylinder 44 while the remaining guide pipes 17 are moved to the left in FIG. 4A by a cylinder 43. Each of the frame members 41 and 42 includes a tamper 45, a vertical moving means 46 for moving the tamper 45 vertically, a screed 47 and a vibrator device 48 for vibrating the screed 47. Each tamper 45 is mounted through a pin 52 on the end portion of a rotary arm 51 which is rotatably connected to a pivotal shaft 49 supported on the frame members 41 and 42. The upper end portion of the tamper 45 is pivotally mounted through an eccentric bushing 58 on a tamper shaft 57 which is rotated through a driving pulley 54, a belt 55 and a driven pulley 56 by a tapering hydraulic motor 53. Thus, the tamper 45 is moved up and down with the shaft 49 acting as a fulcrum by the vertical moving means 46 including the hydraulic motor 53 and the eccentric bushing 58.

The screed 47 is vibrated vertically when a vibrator shaft 63 to which a counterweight 62 is coupled is rotated by a screed hydraulic motor 64. The vibrator shaft 63, being supported by bearings 63*a*, is mounted to the screed 47 and is coupled to the hydraulic motor 64 through a driving pulley 65, a belt 66 and a driven pulley 67. The aforementioned vibrator device 48 includes the hydraulic motor 64, the vibrator shaft 63 and the counterweight 62.

As shown in FIG. 4A, a deflector 71 is provided in front of the main frame 13 on the side of the vehicle body. The deflector 71 has one end connected to the frame member 41 through a connecting member 69, and has the other end provided with a guide rod 72 which is supported by the auxiliary frame 12. Thus, the deflector 72 is movable laterally in accordance with the lateral movement of the frame member 41. The guide rod 72 as shown in FIG. 4B is secured between frames which are provided at the central line and the right edge of the deflector 71, respectively. The guide rod 72 is supported through a spherical bushing 70 to a deflector adjusting screw 74 which is screwed into a threaded hole 73 formed in a supporting member 12*a* which extends towards the vehicle body from the auxiliary frame 12 thus being movable vertically. Furthermore, the left end portion of the deflector 71 is supported by the lower end of a vertical adjusting screw 75 which is screwed into the end supporting member 69*a* of the connecting member 69.

The bearing units 22, 23, 26 and 27 are of the automatic centering type utilizing a spherical bushing.

The operation of the leveling device thus constructed according to the invention will next be described.

Similar to the prior art construction, the leveling device according to the invention is installed on a vehicle body. In the case where the leveling device is installed on an asphalt finisher for instance, the leveling device operates to uniformly level the asphalt compound which is delivered to the spreading screw through the bar feeder from the hopper and which is spread thereby.

Before starting leveling work as described above, first the position of the main frame 13 is corrected by operating the main frame vertical position adjusting screw 16 after which two sets of guide pipes 17 and 18, the screeds 47 relating thereto, the deflector 71, etc. are moved vertically by operating the screed height adjusting screws 33, 34, 35 and 36, so that the height or thickness of the leveled material is set at a desired level. The cylinders 43 and 44 are operated to horizontally move the guide pipes 17 and 18 and the associated mechanisms thereby to determine the width of the leveled material. It goes without saying that the leveling width can be continuously changed from the width of one screed 47 when the cylinders 43 and 44 are contracted maximally to the width of two screeds 47 when the cylinders 43 and 44 are expanded maximally.

In the case where it is required that the leveled surface have a crown, the crown adjusting screws 25 are operated to lift the auxiliary frame 12 and accordingly the inner ends of the guide pipes 17 and 18 are moved upwardly. If in this case the two sets of screeds 47 are coincident in height, the crown contour will coincide with the central line of the auxiliary frame 12. However, if the front screed 47, that is the screed closer to the vehicle body, is lower than the rear screed 47, the crown contour is shifted to the left as viewed in FIG. 4 from the central line of the auxiliary frame 12 depending on the vertical difference between the screeds 47 and the degree of inclination thereof. If the front screed 47 is higher than the rear screed 47, the crown contour is shifted to the right from the central line. The deflector 71 is horizontally moved together with the guide pipe 17 and the frame member 41 through the connecting member 69 by the cylinder 43. The height of the deflector 71 is adjusted by operating the deflector adjusting screws 74 and 75.

Figure 6:
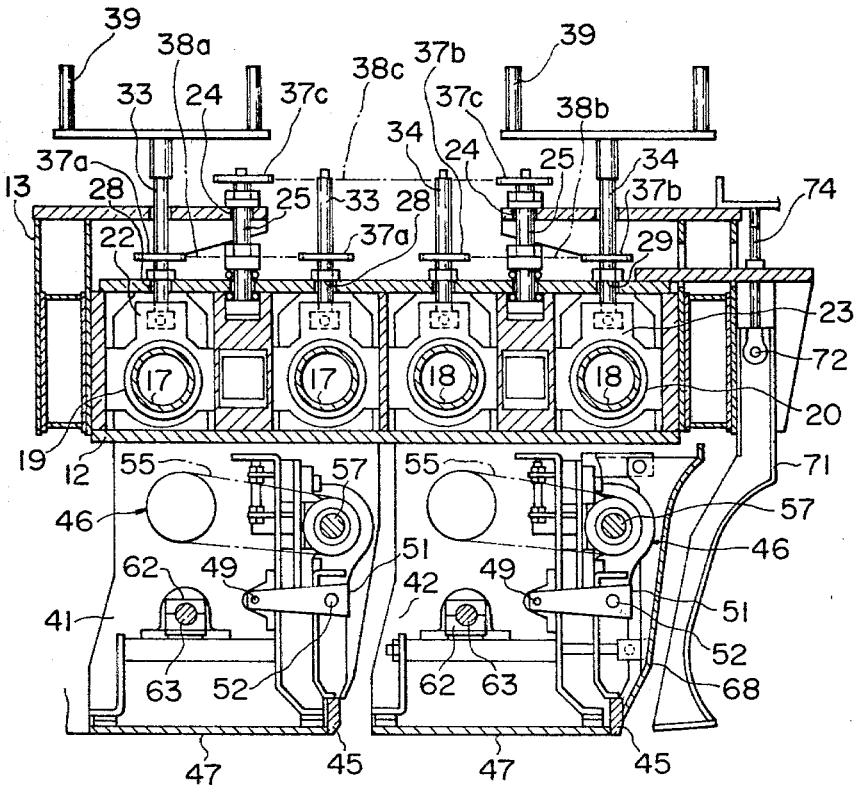
FIG. 6 is a sectional view taken along line VI—VI in FIG. 5.
Figure 7:
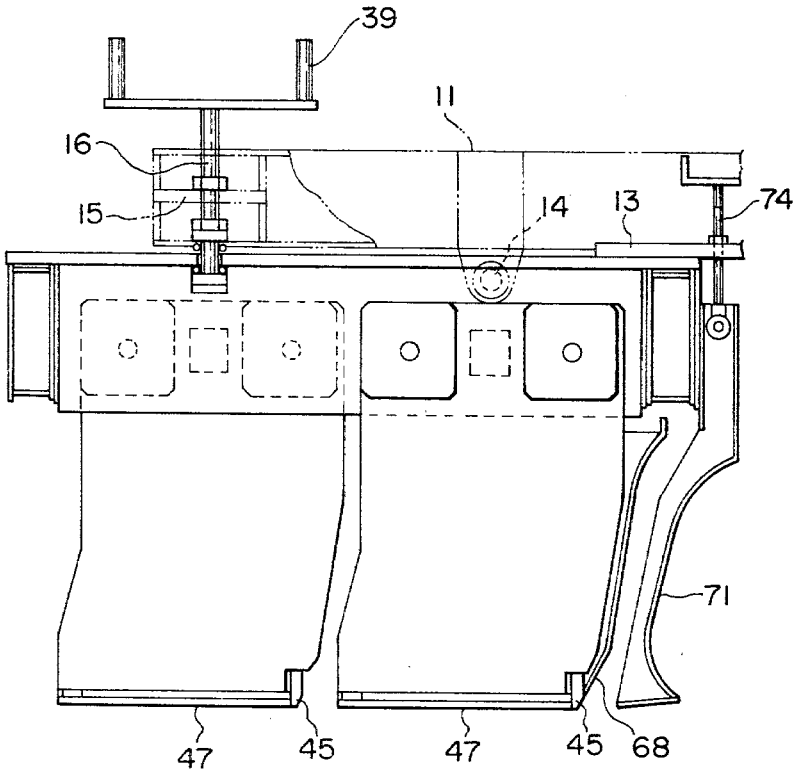
FIG. 7 is a side view of the essential components of the leveling device.

Once the above-described preparation has been completed, the vehicle body is run while the vertically moving means 46 and the vibrating means 48 are operated so that the paving material such as bituminous material is supplied to the right side of the deflectors 68 and 71 in FIG. 6. The material spread in front of the deflector is first suitably leveled by the deflector after which its flatness and compaction are increased as the tamper 45 is moved up and down by the vertical moving means 46. Finally, the material thus treated is tamped by the vibration of the screeds 47.

As is apparent from the above description, in a leveling device according to the invention, two screeds 47 are positioned at the front part and the rear part thereof, respectively, and are movable laterally. Therefore, the leveling width can be quickly and correctly changed by moving the screeds 47 laterally. In addition, as the screeds 47 can be tilted sidewards, it is possible to provide the leveled surface with a crown. Furthermore, it is possible to provide a crown contour at a desired position by the lateral movement and inclination of the screeds.

What is claimed is:

1. A leveling device for an asphalt finisher or the like comprising a pair of screeds for leveling a material such as bituminous material which is spread over a surface such as a road surface, said screeds being positioned at the front part of one side of said device and at the rear part of the opposite side of said device and being laterally movable and tiltable sidewards, and means for separately vibrating said screeds.

2. A leveling device for an asphalt finisher or the like comprising:

a front screed and a rear screed positioned respectively at front and rear portions of said device on opposite lateral portions thereof;

means for mounting said front and rear screeds on a vehicular body wherein both of said screeds are movable laterally and tiltable sidewards, said mounting means comprising for each of said screed;

a main frame;

a pair of supporting arms adapted at one end to be coupled to said vehicular body;

means for pivotally supporting said main frame on said supporting arms; and an auxiliary frame positioned at a central portion of said main frame and being coupled to and movable vertically with respect to said main frame, said screeds being supported by said auxiliary frame and lateral ends of said main frame.

3. The leveling device of claim 2, further comprising:

bearing means disposed in said main frame and said auxiliary frame for supporting said screeds thereon; and at least one adjustment screw for maintaining the position of said auxiliary frame at a selected fixed position relative to said main frame.

4. The leveling device of claim 3, wherein said bearing means comprises bushings for receiving corresponding guide pipes, said guide pipes coupled to said screeds.

5. The leveling device of claim 2, wherein said means for pivotally mounting said main frame comprises:

a supporting shaft; and at least one adjustment screw for maintaining the position of said main frame at a selected fixed tilt position relative to said supporting arms.

6. The leveling device of any one of claims 2 to 5 further comprising at least one deflector means laterally slidably mounted to said main frame.

7. A leveling device for an asphalt finisher or the like comprising:

(a) a front screed and rear screed positioned respectively at front and rear portions of said device on opposite lateral positions thereof, (b) means for mounting said front and rear screeds on a vehicle body wherein both of said screeds are movable laterally and tiltable sidewards, said mounting means comprising, for each of said screeds, a main frame;

a pair of supporting arms adapted at one end to be pivotally coupled to said vehicular body;

means for pivotably supporting said main frame on said supporting arms;

crown adjustment screws;

an auxiliary frame coupled to said main frame; said auxiliary frame being positioned at a central portion of said main frame and being movable vertically relative to said main frame by means of said crown adjustment screws, said screeds being supported by said main frame and said auxiliary frame;

a first set of bearing means and a second set of bearing means adapted to support said screeds thereon, said first set of bearing means being disposed in said auxiliary frame, said second set of bearing means being disposed in said main frame;

first and second set of screed height adjusting screws, said first set of screed height adjusting screws being connected to said first set of bearing means to control vertical positions thereof relative to said auxiliary frame, and said second set of screed height adjusting screws being connected to said second set of bearing means to control vertical positions thereof relative to said main frame.

* * * * *